US007407065B2

(12) United States Patent
Hooks et al.

(10) Patent No.: US 7,407,065 B2
(45) Date of Patent: Aug. 5, 2008

(54) METHOD OF DISCHARGING AN AEROSOLIZED FLUID

(75) Inventors: Aaron L. Hooks, Warsaw, IN (US); Scott Dewitt, Syracuse, IN (US)

(73) Assignee: Pent Technologies, Inc., Kendallville, IN (US)

( * ) Notice: Subject to any disclaimer, the term of this patent is extended or adjusted under 35 U.S.C. 154(b) by 579 days.

(21) Appl. No.: 11/064,472

(22) Filed: Feb. 23, 2005

(65) Prior Publication Data

US 2005/0139624 A1 Jun. 30, 2005

Related U.S. Application Data

(63) Continuation-in-part of application No. 10/779,886, filed on Feb. 17, 2004, now Pat. No. 6,877,636.

(60) Provisional application No. 60/448,025, filed on Feb. 18, 2003.

(51) Int. Cl.
*B67B 7/00* (2006.01)

(52) U.S. Cl. ..... 222/1; 222/52; 222/61; 222/135; 222/645; 222/649; 239/70

(58) Field of Classification Search ..... 222/1, 222/52, 645, 61, 63, 504, 646–649, 644, 222/641, 402.13, 402.1, 94, 135, 183, 131; 251/129.05; 239/67–70
See application file for complete search history.

(56) References Cited

U.S. PATENT DOCUMENTS 3,310,144 A * 3/1967 Sandhoff ..... 194/241
3,589,563 A 6/1971 Carragan et al. ..... 222/70
3,627,176 A 12/1971 Sailors ..... 222/70
3,666,144 A 5/1972 Winder ..... 222/70
3,677,441 A * 7/1972 Nixon et al. ..... 222/63
3,974,941 A 8/1976 Mettler ..... 222/70
3,980,205 A * 9/1976 Smart ..... 222/649
4,006,844 A 2/1977 Corris ..... 222/70
4,063,664 A * 12/1977 Meetze, Jr. ..... 222/648
4,077,542 A 3/1978 Petterson ..... 222/70
4,415,797 A 11/1983 Choustoulakis ..... 219/273
4,553,702 A * 11/1985 Coffee et al. ..... 239/690
4,658,985 A 4/1987 Madsen et al. ..... 222/1
5,012,961 A 5/1991 Madsen et al. ..... 222/643

(Continued)

FOREIGN PATENT DOCUMENTS

GB 2 153 680 A 8/1985

*Primary Examiner*—Frederick C. Nicolas

(57) ABSTRACT

A method of discharging a plurality of aerosolized fluids from a plurality of aerosol cans to an ambient environment, including the steps of: fluidly coupling a first solenoid valve of an aerosol delivery system with a first aerosol can; fluidly coupling a second solenoid valve of the aerosol delivery system with a second aerosol can; determining a first release sequence of a first aerosolized fluid from the first aerosol can; determining a second release sequence of a second aerosolized fluid from the second aerosol can, the second release sequence being independent of the first release sequence; actuating both the first solenoid valve and the second solenoid valve using an electronic controller electrically coupled to the first solenoid valve and the second solenoid valve to release the first aerosolized fluid according to the first release sequence and the second aerosolized fluid according to the second release sequence to the ambient environment.

10 Claims, 8 Drawing Sheets

U.S. PATENT DOCUMENTS

| | | | | |
|---|---|---|---|---|
| 5,029,729 | A | 7/1991 | Madsen et al. | 222/1 |
| 5,038,972 | A * | 8/1991 | Muderlak et al. | 222/25 |
| 6,216,925 | B1 | 4/2001 | Garon | 222/645 |
| 6,267,297 | B1 * | 7/2001 | Contadini et al. | 239/1 |
| 6,293,442 | B1 | 9/2001 | Mollayan | 222/504 |
| 6,533,141 | B1 | 3/2003 | Petterson | 222/1 |
| 6,540,155 | B1 | 4/2003 | Yahav | 239/70 |
| 6,877,636 | B2 * | 4/2005 | Speckhart et al. | 222/1 |

* cited by examiner

METHOD OF DISCHARGING AN AEROSOLIZED FLUID

CROSS REFERENCE TO RELATED APPLICATIONS

This application is a continuation-in-part of U.S. patent application Ser. No. 10/779,886, entitled "METHOD OF DISCHARGING AN AEROSOLIZED FLUID", filed Feb. 17, 2004.

BACKGROUND OF THE INVENTION

1. Field of the Invention

The present invention relates to aerosolized chemical delivery systems, and, more particularly, to methods of discharging an aerosolized fluid from such aerosol delivery systems.

2. Description of the Related Art

Aerosol delivery systems can be used to deliver a liquid chemical to the ambient environment. For example, an aerosol can may contain a fragrance, insecticide, anti-mold compound or an anti-mildew compound which is continuously or periodically discharged to the ambient environment.

A problem with a chemical delivery system as described above is that pressure within the aerosol can decreases over time, resulting in a lesser amount of the liquid chemical being discharged to the ambient environment as the pressure decreases. It is known to address the problem of a decreasing pressure in the aerosol can by increasing the duration of the delivery pulse from the aerosol can to the ambient environment. See, for example, FIG. 3 and U.S. Pat. No. 5,029,729 (Madsen, et al.). Madsen, et al. '729 also discloses that it is possible to use a constant release period and increase the frequency of release over time to offset the decreasing pressure (FIG. 4). Madsen, et al. '729 does not address the possibility of increasing both the release duration as well as the cycle frequency for the purpose of addressing the decrease in pressure within the aerosol can.

Another problem is that regardless of whether release periods are adjusted to accommodate the decrease in pressure within the aerosol can, the user may become habituated to the smell of the liquid chemical in the case of a fragrance which is discharged to the ambient environment. This clearly is not desirable as the user is unable to detect the pleasant aroma given off by the liquid fragrance.

Another problem is that certain chemicals such as an insecticide, an anti-mold compound or an anti-mildew compound can have a less than pleasant smell.

Another problem is that consumers may desire thematic fragrancing of multiple fragrances.

Another problem is that consumers may desire using or alternating a fragrance with other chemical compounds, or may desire alternating or otherwise combining multiple chemical compounds.

What is needed in the art is an aerosol delivery system, which is operated in such a manner that problems of both decreased pressure within the aerosol can as well as user habituation are accommodated.

Additionally, what is needed in the art is an aerosol delivery system, which can accommodate multiple chemical compounds.

SUMMARY OF THE INVENTION

The present invention provides a method of actuating an aerosol delivery system, which avoids user habituation and automatically adjusts for a decreasing pressure over time in the aerosol can.

The invention comprises, in one form thereof, a method of discharging an aerosolized fluid from an aerosol can to an ambient environment, including the steps of: fluidly coupling a solenoid valve of an aerosol release device with a discharge valve on the aerosol can; determining a duration of a first release period of the aerosolized fluid from the aerosol can; actuating the solenoid valve using an electronic controller to thereby release the aerosolized fluid to the ambient environment for the duration of the first release period; determining a duration of a second release period of the aerosolized fluid from the aerosol can, the duration of the second release period being randomly varied to avoid user habituation of the aerosolized fluid; and actuating the solenoid valve using the electronic controller to thereby release the aerosolized fluid to the ambient environment for the duration of the second release period.

The invention comprises, in another form thereof, a method of discharging an aerosolized fluid from an aerosol can to an ambient environment, including the steps of: fluidly coupling a solenoid valve of an aerosol release device with a discharge valve on the aerosol can; determining a duration of a first release period of the aerosolized fluid from the aerosol can; actuating the solenoid valve using an electronic controller to thereby release the aerosolized fluid to the ambient environment for the duration of the first release period; determining a decreasing pressure profile over time of the aerosolized fluid within the aerosol can; determining a duration of a second release period of the aerosolized fluid from the aerosol can, dependent upon the decreasing pressure profile, the duration of the second release period being increased in both frequency and duration over time relative to the first release period; and actuating the solenoid valve using the electronic controller to thereby release the aerosolized fluid to the ambient environment for the duration of the second release period.

The invention comprises, in another form thereof, a method of discharging a plurality of aerosolized fluids from a plurality of aerosol cans to an ambient environment, including the steps of: fluidly coupling a first solenoid valve of an aerosol delivery system with a first aerosol can; fluidly coupling a second solenoid valve of the aerosol delivery system with a second aerosol can; determining a first release sequence of a first aerosolized fluid from the first aerosol can, the first release sequence including both a first release period as a function of time and a first frequency of the first release period as a function of time; determining a second release sequence of a second aerosolized fluid from the second aerosol can, the second release sequence including both a second release period as a function of time and a second frequency of the second release period as a function of time, the second release sequence being independent of the first release sequence; actuating both the first solenoid valve and the second solenoid valve using an electronic controller electrically coupled to the first solenoid valve and the second solenoid valve to thereby release the first aerosolized fluid according to the first release sequence and the second aerosolized fluid according to the second release sequence to the ambient environment.

The invention comprises, in another form thereof, an aerosol delivery system including a first aerosol container and a second aerosol container. A first solenoid valve is fluidly coupled with the first aerosol container. A second solenoid valve is fluidly coupled with the second aerosol container. A controller is electrically connected to both the first solenoid valve and the second solenoid valve. The controller includes at least one algorithm for independently controlling both the first solenoid valve and the second solenoid valve. A battery is connected to the controller. At least one triggering input initiates at least one algorithm.

An advantage of the present invention is that user habituation to the fluid chemical delivered to the ambient environment is avoided.

A further advantage is that both the period between adjacent release periods and/or the duration of the release period can be randomly varied to avoid user habituation.

Another advantage is that delivery of the fluid chemical is automatically adjusted to accommodate a decreasing pressure over time in the aerosol can.

Yet another advantage is that an additional amount of the fluid chemical may be manually dispersed to the ambient environment by depressing a manual switch.

Another advantage of the present invention is that it can deliver multiple chemicals and/or chemical compounds independent of one another.

Another advantage of the present invention is that it can release multiple chemicals and/or chemical compounds according to respective independent release sequences.

Another advantage of the present invention is that the independent release sequences can be triggered in a variety of ways.

Another advantage of the present invention is that the independent release sequences can be triggered independently, and can also be triggered by different triggering events/elements.

Another advantage of the present invention is that no electrical mains outlet is needed and therefore no outlets are blocked.

Another advantage of the present invention is that it has a relatively low power utilization.

Another advantage of the present invention is that it presents a reduced risk of fire and electrical shock.

Another advantage of the present invention is that dual voltage (U.S., European) concerns are eliminated.

Another advantage is that present invention can be placed where needed instead of where power is available.

Another advantage of the present invention is that a battery operated common platform eliminates complex regional requirements.

Another advantage is that the portable active aerosol delivery system of the present invention inherently has design flexibility so that designer can design the present invention to complement or contrast current style trends.

Another advantage is that there is a broad material selection available relative to the expendable and nonexpendable materials used in the present invention.

Another advantage of the present invention is a simple loading procedure secures the aerosol canister into an attractive housing, which makes changing aerosolized fluids and/or replenishing fluids easy.

Another advantage of the present invention is additional algorithms can be added with little or no additional cost to manufacture, and therefore appropriate features and options can be added or included for a given application.

Another advantage of the present invention is that many different types of input devices, triggering devices and/or sensors can be used, therefore allowing tailored performance to specific applications.

Another advantage of the present invention is that habituation of a fragrance by a user can be addressed with a non-linear delivery in a predetermined fashion.

Another advantage of the present invention is that dispense time or release sequence of a chemical can be altered as battery power becomes less effective in completely opening the solenoid valve associated with the chemical canister.

BRIEF DESCRIPTION OF THE DRAWINGS

The above-mentioned and other features and advantages of this invention, and the manner of attaining them, will become more apparent and the invention will be better understood by reference to the following description of embodiments of the invention taken in conjunction with the accompanying drawings, wherein.

Corresponding reference characters indicate corresponding parts throughout the several views. The exemplifications set out herein illustrate one preferred embodiment of the invention, in one form, and such exemplifications are not to be construed as limiting the scope of the invention in any manner.

DETAILED DESCRIPTION OF THE INVENTION

Figure 1:
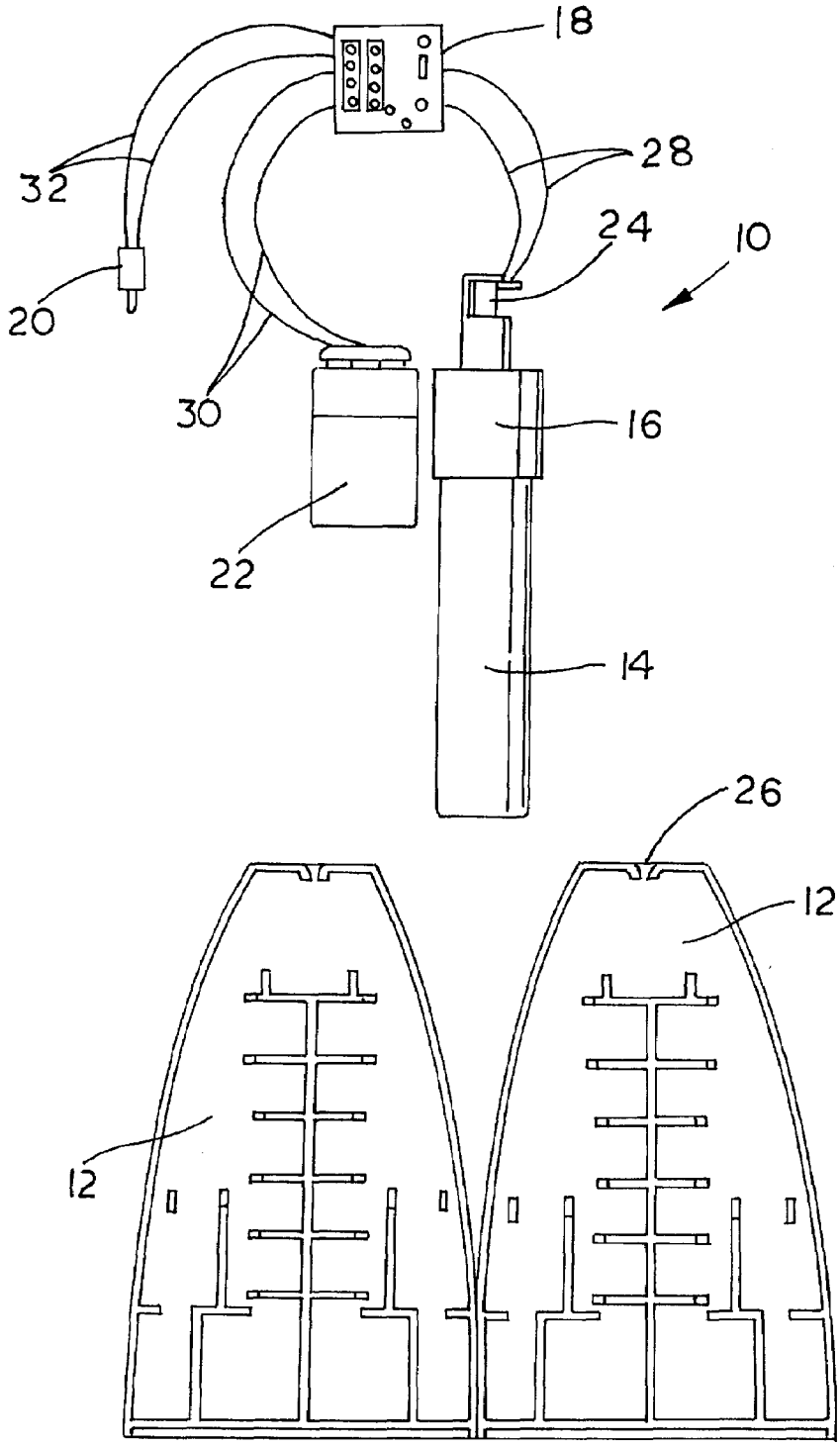
FIG. 1 is an exploded view of an embodiment of an aerosol delivery system, which may be used for carrying out the method of the present invention.
Figure 2:
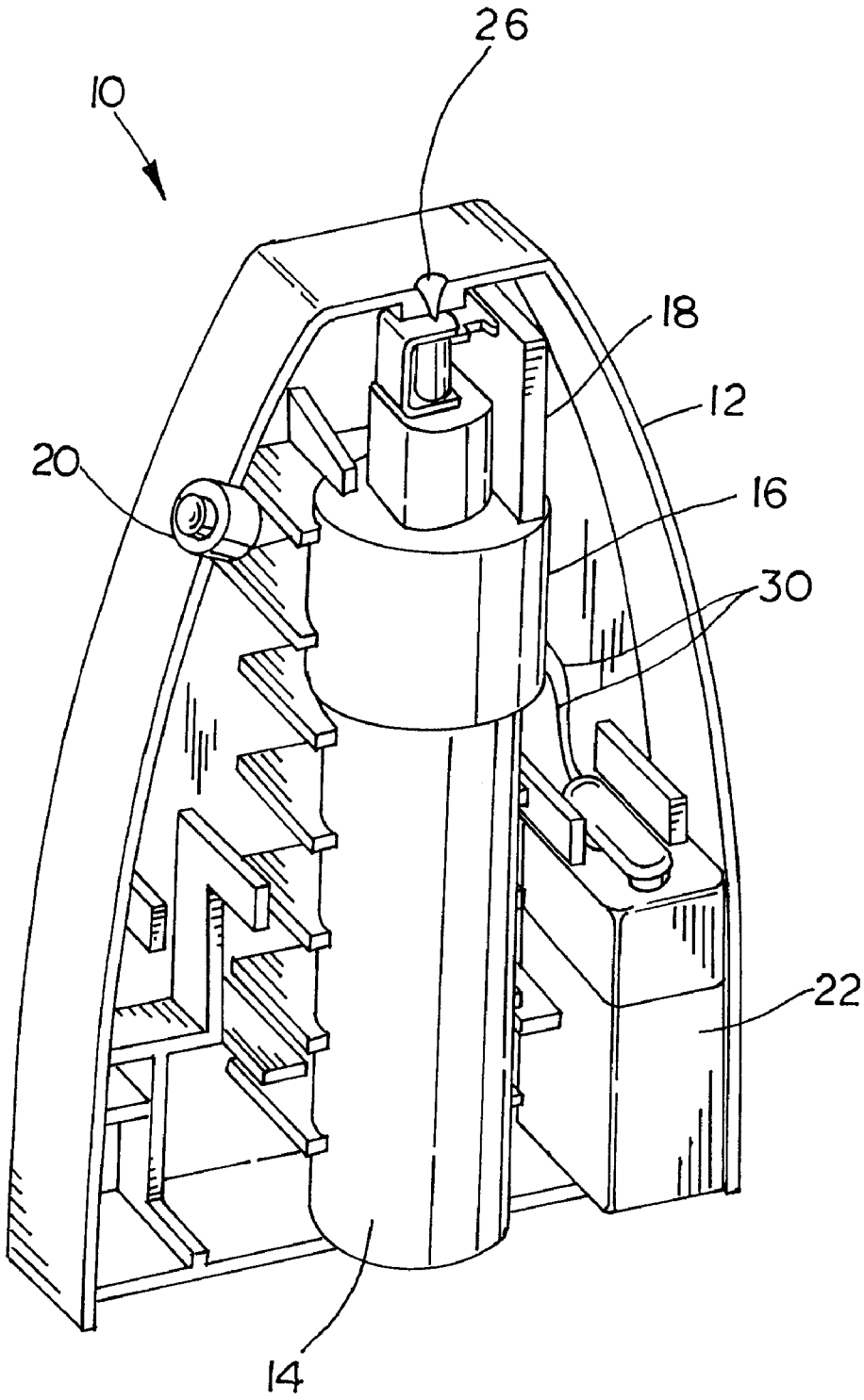
FIG. 2 is an assembled view of the aerosol delivery system of FIG. 1, with part of the housing removed.
Figure 3:
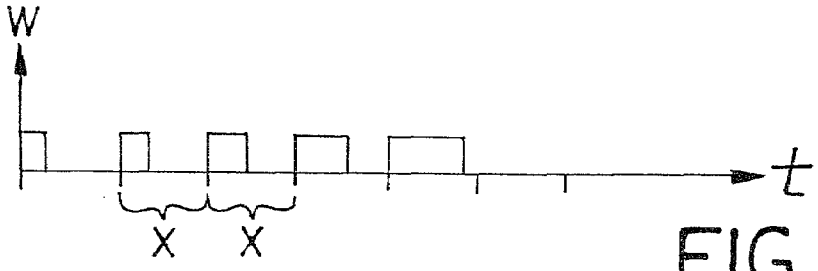
FIG. 3 PRIOR ART
FIG. 3 is a graphical illustration of a prior art method of actuating an aerosol delivery system.
Figure 4:
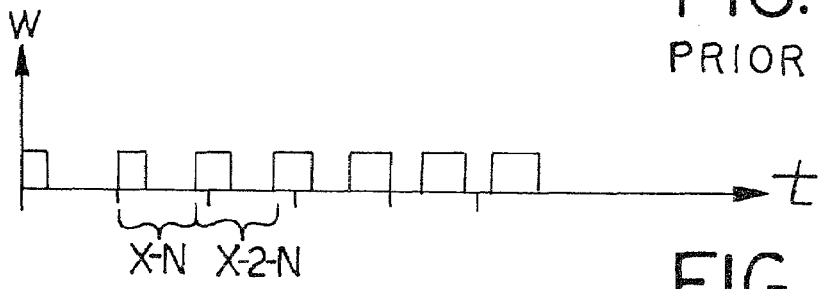
FIG. 4 PRIOR ART
FIG. 4 is a graphical illustration of another prior art method of actuating an aerosol delivery system.

Referring now to the drawings, and more particularly to FIGS. 1 and 2, there is shown an embodiment of an aerosol delivery system 10 which may be used for carrying out the method of the present invention. Aerosol delivery system 10 generally includes a housing 12, aerosol can 14, solenoid valve 16, electronic controller 18, manual switch 20 and battery 22.

Aerosol can 14 contains an aerosolized fluid therein which is selectively discharged to the ambient environment. In the embodiment shown, aerosol can 14 contains a fragrance therein, but may also contain an insecticide, an anti-mold compound, and/or other suitable liquid chemicals to be discharged to the ambient environment.

An aerosol release device is coupled with the discharge end of aerosol can 14. The aerosol release device generally includes solenoid valve 16, electronic controller 18, manual switch 20 and battery 22.

Solenoid valve 16 is coupled with the discharge end of aerosol can 14, and maintains the discharge valve (not specifically shown) of aerosol can 14 in a depressed position. Since the discharge valve of aerosol can 14 is maintained in the open or depressed position, fluid discharge to the ambient environment is entirely controlled by operation of solenoid valve 16. Solenoid valve 16 may be of conventional design, and includes a discharge outlet 24, which is positioned in alignment with a discharge orifice 26 formed in housing 12 when aerosol can 14 is positioned within housing 12.

Electronic controller 18 is electrically coupled with solenoid valve 16 via electrical wires 28. Electronic controller 18 includes suitable electrical components, such as a processor, resistors, etc. Electronic controller 18 is electrically coupled with battery 22 via electrical wires 30. In the embodiment shown, battery 22 is a conventional nine-volt battery. Manual switch 20 is electrically coupled with electronic controller 18 via electrical wires 32, and upon actuation causes manual actuation of solenoid valve 16 through electrical wires 28.

Figure 5:
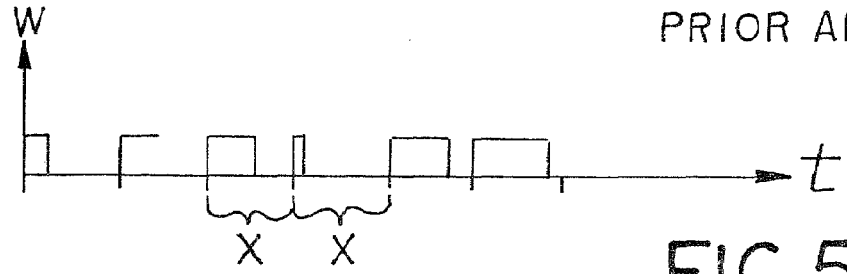
FIG. 5 is a graphical illustration of an embodiment of the method of the present invention for actuating an aerosol delivery system such as shown in FIGS. 1 and 2.
Figure 6:
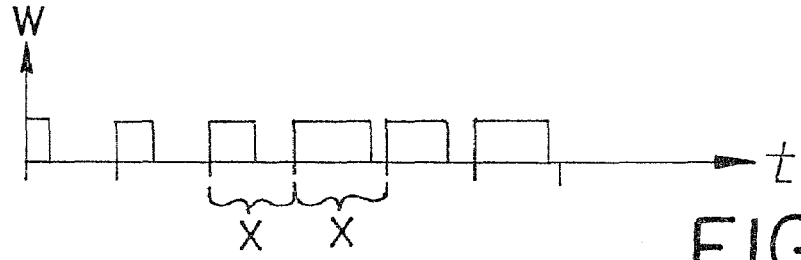
FIG. 6 is a graphical illustration of another embodiment of the method of the present invention for actuating an aerosol delivery system.
Figure 7:
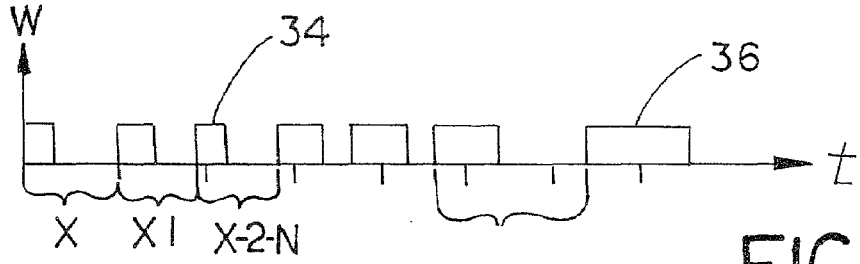
FIG. 7 is a graphical illustration of yet another embodiment of the method of the present invention for actuating an aerosol delivery system.

Referring now to FIGS. 5-7, an embodiment of the method of the present invention for discharging an aerosolized fluid from aerosol can 14 to the ambient environment using, e.g., aerosol delivery system 10 will be described in further detail. As will be appreciated, the pressure within aerosol can 14 decreases over time, dependent upon the amount of fluid which is discharged from aerosol can 14. As the pressure decreases, the volume of the liquid which is discharged to the ambient environment over a period of time increases. In the embodiment shown in FIG. 5, the duration during which the solenoid valve is held open during a release period is generally increased in a stepwise linear fashion. For the purposes of illustration, it may be observed in FIG. 5 that except for the duration beginning at the fourth release period, the duration for the other release periods increase generally linearly for each successive release period.

Of course, it will also be appreciated that the duration for a release period may be kept at a constant volume for a number or block of release periods, with adjacent blocks of release periods being stepwise linearly increased. For example, it is possible to have the first three release periods of a given duration, the next three release periods of a longer duration, the next three release periods of a still longer duration, etc.

With the foregoing general chemical release scheme as illustrated in FIG. 5, solenoid valve 16 is actuated for successively longer periods of time to accommodate the decrease in pressure in aerosol can 14. However, this stepwise linear increase in the duration of the release period neglects the tendency of a user to become habituated from the liquid chemical which is discharged into the ambient environment. To avoid user habituation, the method of the present invention interjects a randomness to the discharge of the liquid chemical to the ambient environment. In the embodiment shown in FIG. 5, the randomly generated pulse width or duration of the fourth release period (the first release beginning at time=0) is not in sync with the duration of the preceding and succeeding release periods. That is, it would be expected that the duration of the randomly generated fourth release period would be longer than that of the third release period and shorter than that of the fifth release period. However, as can be observed, the duration of the fourth release period is much shorter than any of the other release periods. The randomness of the duration of the fourth release period is intended to overcome the problem of user habituation.

As may also be observed in FIG. 5, each release period begins at a constant frequency or period X relative to preceeding and succeeding release periods. In addition to generating a random duration for a particular release period, it is also possible to randomize the frequency of the release periods to avoid user habituation.

FIG. 6 illustrates another embodiment of a method of the present invention for avoiding user habituation. Particularly, a method of discharging an aerosolized fluid is shown in FIG. 6 at a constant period cycle for each release period, beginning each release period at a period X from an adjacent release period. Also similar to FIG. 5, the method shown in FIG. 6 has a stepwise linear increase for the duration of each release period over time. However, with the fourth release period (beginning at the third hash mark), the duration of the release period is randomized and is not in the expected sequence relative to the other release periods. That is, the duration of the fourth release period is much longer than it should be in a stepwise linear increased manner for the purpose of avoiding user habituation.

FIG. 7 illustrates yet another embodiment of a method of discharging an aerosolized fluid from an aerosol can. In the embodiment shown in FIG. 7, the overall scheme to compensate for reduction in pressure is not to increase the duration of each release period, but rather to increase the frequency (i.e. decrease the period size) for succeeding release periods over time. To that end, the cycle period is decreased in a stepwise linear fashion an amount for each succeeding release period. For the period of time shown in FIG. 7, two randomized release periods 34 and 36 having randomized release durations are illustrated. Moreover, the period cycles associated with each randomized release period 34 and 36 are likewise randomized. For example, the period cycle preceeding release period 34 has the reduced period cycle X-N. However, the period cycle has been randomized to the duration $X_1$. Similarly, the period cycle preceeding release period 36 has been randomized to cycle period $X_2$.

As a further possibility of randomization which may be used for the purpose of avoiding user habituation, it is assumed in the above example that randomized release periods are a set integer number away from each other. For example, the randomized release period 36 is four release periods away from the randomized release period 34. However, it is also possible for the purpose of avoiding user habituation to randomize the integer number between adjacent randomized release periods. That is, the spacing between two adjacent randomized release periods could be four cycle periods and the spacing between another two randomized release periods could be six cycle periods.

Figure 8:
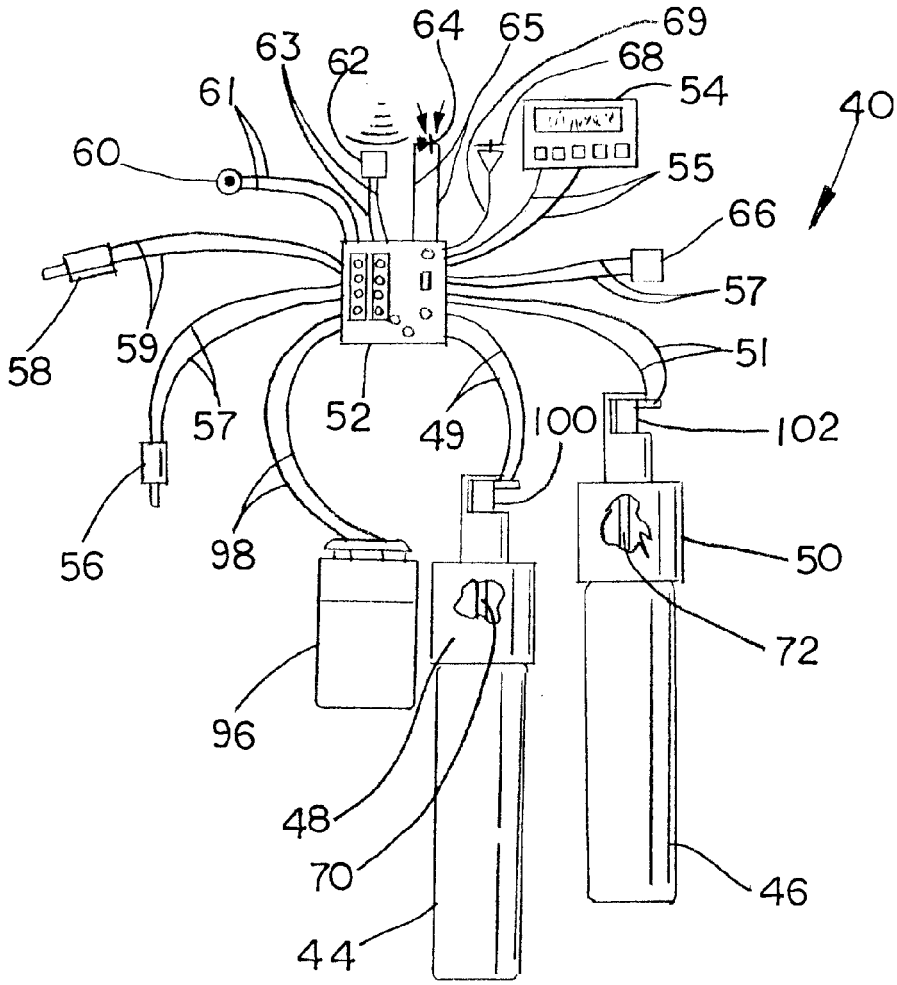
FIG. 8 is an exploded, partially fragmentary view of another embodiment of an aerosol delivery system, which may be used for carrying out the method of the present invention, and which can accommodate a plurality of aerosol fluids.
Figure 8:
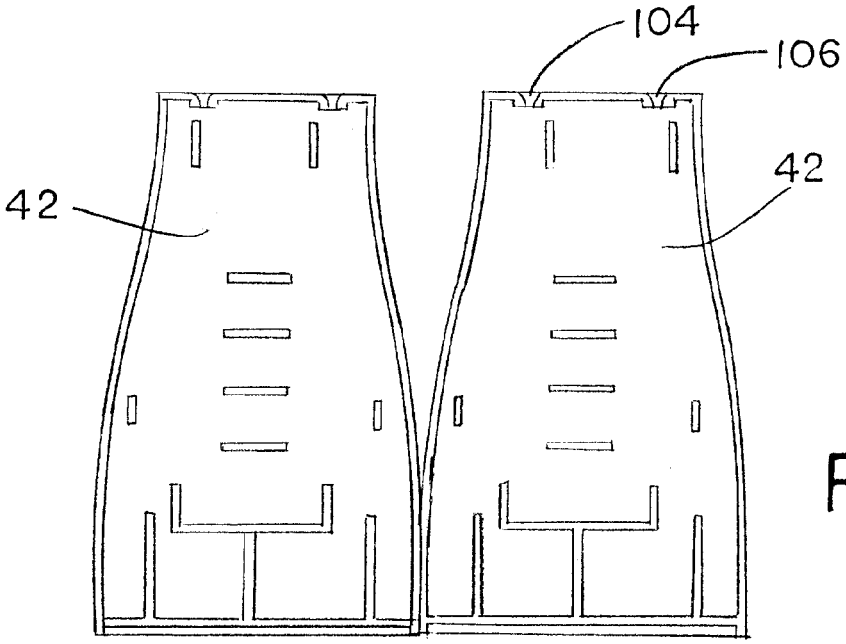
Figure 9:
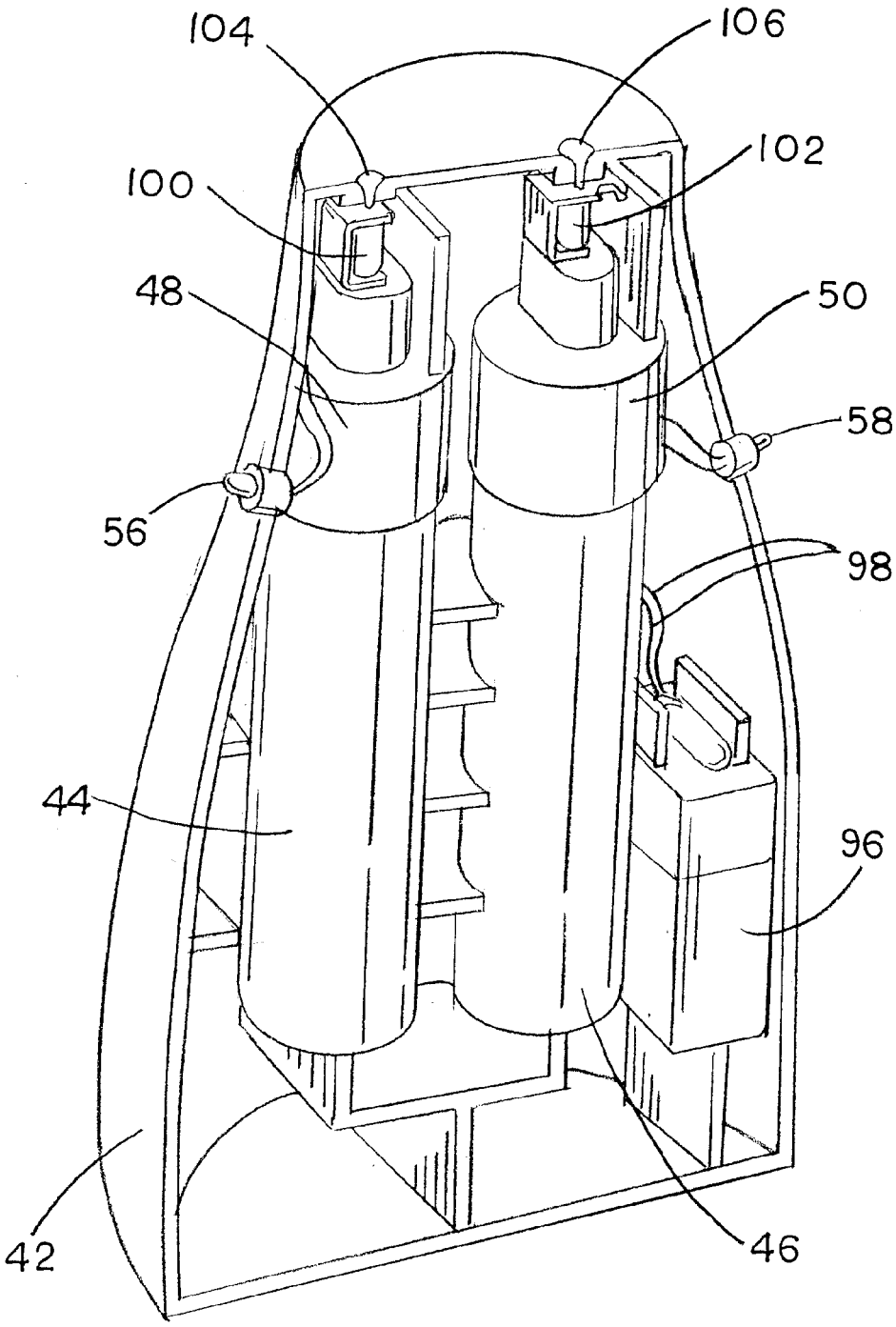
FIG. 9 is an assembled view of the aerosol delivery system of FIG. 8, with part of the housing removed.
Figure 10:
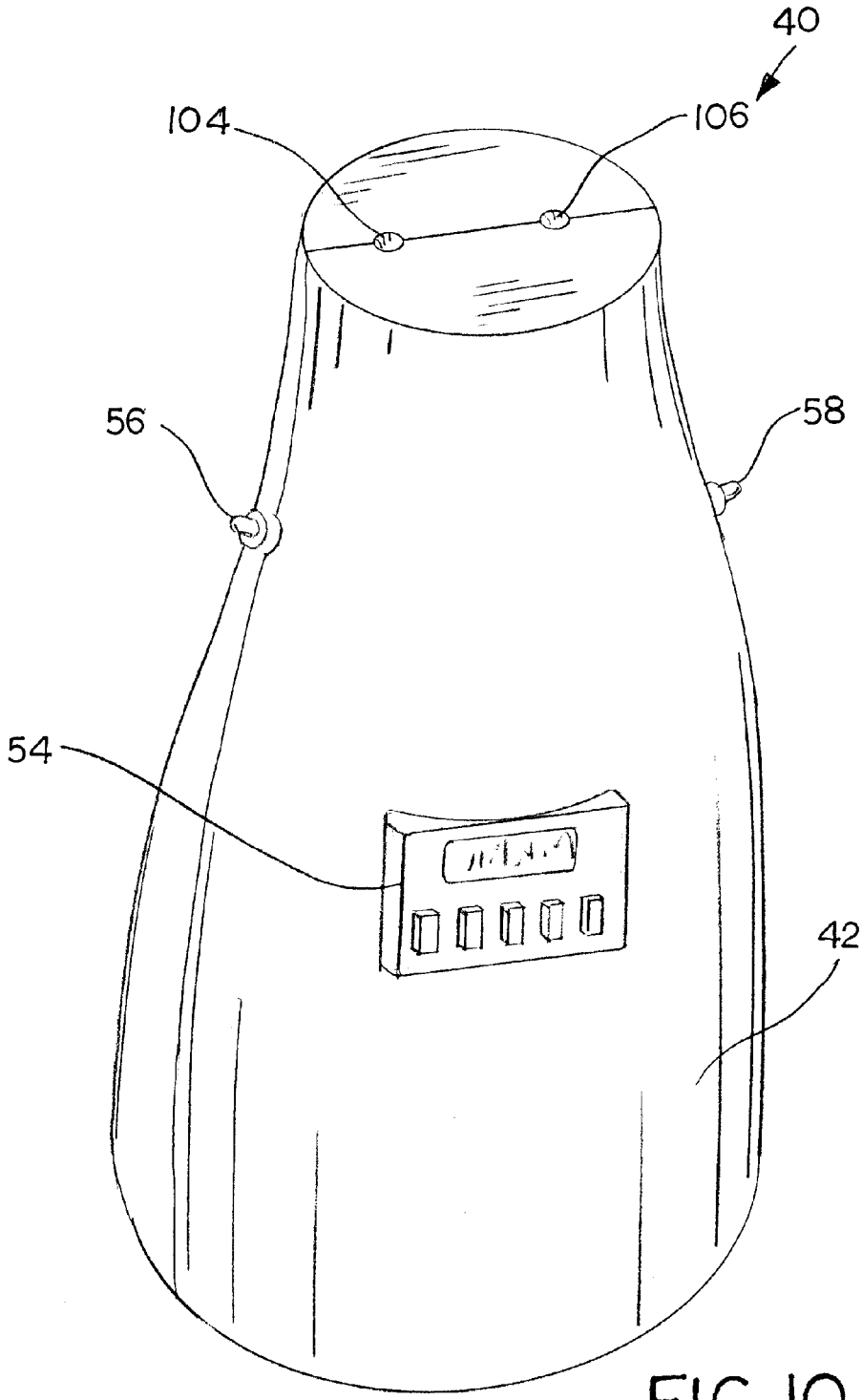
FIG. 10 is an assembled front view of the aerosol delivery system of FIG. 8.

Referring now to FIGS. 8-12, and more particularly to FIGS. 8-10, there is shown another embodiment of an aerosol delivery system 40 which may be used for carrying out the method of the present invention. Aerosol delivery system 40 generally includes a housing 42, aerosol cans 44, 46, solenoid valves 48, 50, electronic controller 52, and battery 96. In order to further capitalize on the anti-habituation methods described above and/or to combine the functionality of a fragrance and insecticide, for example, each of aerosol cans 44, 46 can contain a different aerosolized fluid therein such as a fragrance, an odor elimination or neutralization chemical, an insecticide, a fabric freshening/protection chemical, camphor/menthol preparations, an anti-mold chemical, an anti-mildew chemical and/or other suitable liquid chemicals to be discharged to the ambient environment. Aerosol delivery system 40 can include at least one triggering input such as an input/display unit 54, manual switches 56, 58, a temperature sensor 60, an audio sensor 62, a light sensor 64, a motion sensor 66, a radio sensor 68 and/or a subroutine of an algorithm within firmware on electronic controller 52.

Electronic controller 52 is electrically coupled with solenoid valves 48, 50 via electrical wires 49, 51, respectively. Electronic controller 52 includes suitable electrical components, such as a processor, memory, I/O, resistors, etc. Electronic controller 52 is electrically coupled with battery 96 via electrical wires 98, and battery 96 provides power for aerosol delivery system 40. In the embodiment shown, battery 96 is a conventional nine-volt battery. Manual switches 56, 58 are electrically coupled with electronic controller 52 via electrical wires 57, 59, respectively, and are associated with solenoid valves 48, 50, respectively. An actuation of a manual switch 56, 58 causes manual actuation of a respective solenoid valve 48, 50 through electrical wires 49, 51. Similarly, input/display unit 54, temperature sensor 60, audio sensor 62, light sensor 64, motion sensor 66 and radio sensor 68 are electrically coupled with electronic controller 52 via electrical wires 55, 61, 63, 65, 67, 69 to provide a triggering input, according to their respective sensed energy, to one or both of solenoid valves 48, 50 in order to operate them as is described below.

Aerosol delivery system 40 can include the elements previously described for aerosol delivery system 10 and shown in FIGS. 1-7, but differs from aerosol delivery system 10 by at least having other triggering inputs potentially available as described above and including a plurality of aerosol cans 44, 46 each having a corresponding discharge valve 70, 72. Each of solenoid valves 48, 50 are fluidly coupled to a respective discharge valve 70, 72. Solenoid valves 48, 50 are coupled with the discharge end of aerosol cans 44, 46, respectively, and maintain the corresponding discharge valves 70, 72 of aerosol cans 44, 46 in a depressed position. Since the discharge valve of a respective aerosol can is maintained in the open or depressed position, fluid discharge to the ambient environment is entirely controlled by operation of a respective solenoid valve 48, 50. Solenoid valves 48, 50 may include respective discharge outlets 100, 102, which are positioned in alignment with respective discharge orifices 104, 106 formed in housing 42 when aerosol cans 44, 46 are positioned within housing 42.

Figure 11:
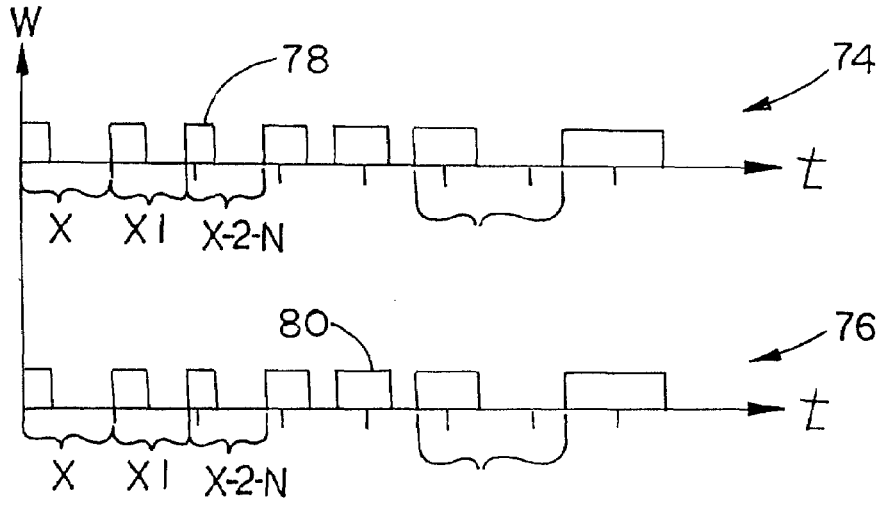
FIG. 11 is a graphical illustration of an embodiment of the method of the present invention for actuating an aerosol delivery system such as shown in FIGS. 8-10, and showing first and second release sequences corresponding to first and second aerosol cans, respectively.
Figure 12:
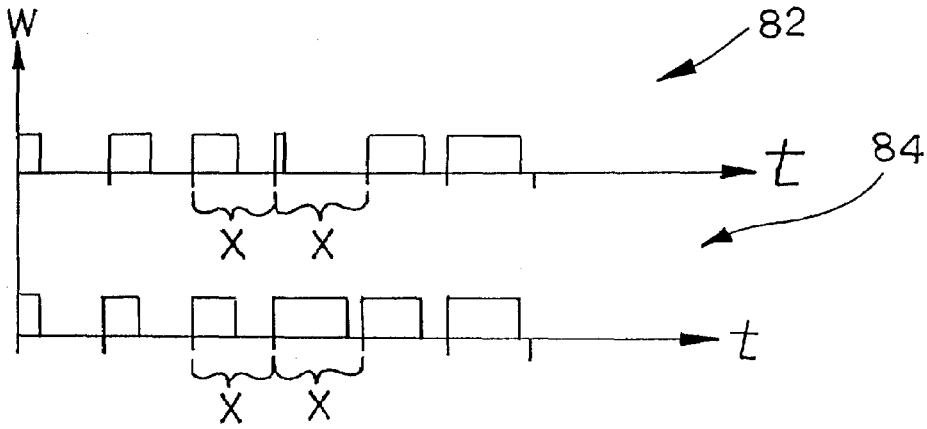
FIG. 12 is a graphical illustration of another embodiment of the method of the present invention for actuating an aerosol delivery system such as shown in FIGS. 8-10, and showing first and second release sequences corresponding to first and second aerosol cans, respectively.

As shown in FIG. 11, solenoid valve 48 can have a release sequence 74 associated therewith, for example, which determines when solenoid valve 48 is actuated on and off to release a first aerosolized fluid within aerosol can 44 to the ambient environment. The horizontal axis of both FIGS. 11 and 12 represent time, therefore the pulse widths (78, for example) indicate an on release period for solenoid valve 48. In general, release sequence 74 includes both a release period as a function of time, i.e. the release period can vary as a function of time, and a frequency of the release period as a function of time, i.e. how often an on pulse occurs per unit time can vary as a function of time, as is shown in FIG. 11.

Similarly, solenoid valve 50 can have a release sequence 76 associated therewith, for example, which determines when solenoid valve 50 is actuated on and off to release a second aerosolized fluid within aerosol can 46 to the ambient environment. The pulse widths (80, for example) indicate an on release period for solenoid valve 50. In general, release sequence 76 includes both a release period as a function of time, i.e. the release period can vary as a function of time, and a frequency of the release period as a function of time, i.e. how often an on pulse occurs per unit time can vary as a function of time, as is shown in FIG. 11.

FIG. 11 demonstrates how two aerosol cans 44, 46 can be dispensed independently but similarly, and in this case, according to the release sequence previously described for FIG. 7. Release sequences 74 and 76 are shown in phase in FIG. 11, but can also be out of phase by shifting one of release sequences 74 and 76 in time. An example of an application of the release sequences 74 and 76 may be when aerosol can 44 includes an anti-mold compound and aerosol can 46 includes a fragrance to mask the unpleasant smell of the anti-mold compound.

FIG. 12 demonstrates how two aerosol cans 44, 46 can be dispensed independently according to release sequences 82 (as described in FIG. 5 previously), 84 (as described in FIG. 6 previously), respectively. Release sequences 82 and 84 are shown out of phase in FIG. 12. The present invention is not limited to the combinations shown in FIGS. 11 and 12, but instead solenoid valves 48, 50 can be actuated through controller 52 by independent release sequences which are any combination of the release sequences of FIGS. 3-7 and/or which are similar, different, in phase, out of phase or some combination thereof. Consequently, aerosol delivery system 40 can support a multi-application where aerosol can 44 can include an insecticide which is operated according to a first release sequence which only activates solenoid valve 48 during the night; and aerosol can 46 can include a fragrance which is operated according to a second release sequence, independent of the first release sequence, which only activates solenoid valve 50 during the day, for example.

Figure 13:
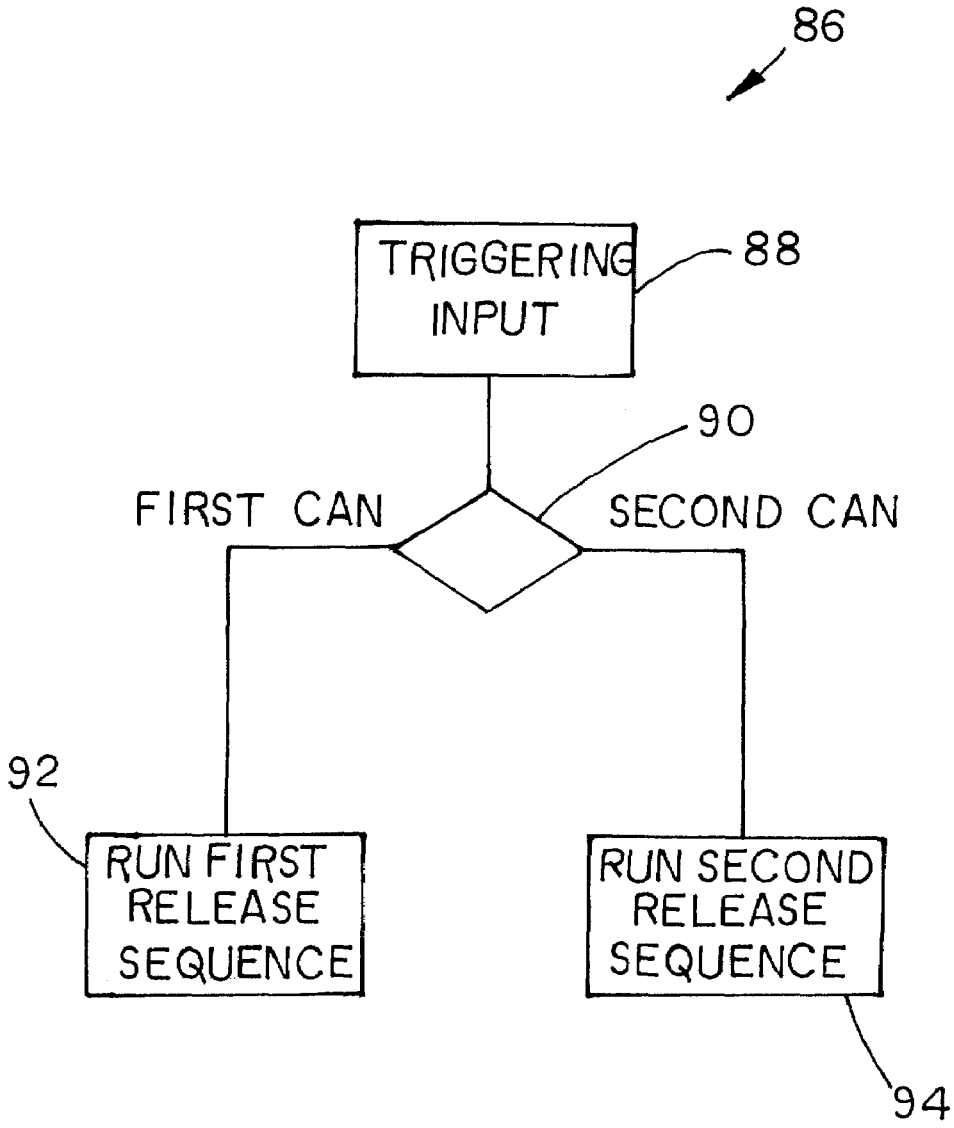
FIG. 13 is a flowchart of an algorithm according to the present invention.

FIG. 13 demonstrates a flowchart for an algorithm 86 which can independently control both solenoid valve 44 and solenoid valve 46. Step 88 accepts at least one of the triggering inputs described above which initiates algorithm 86. Step 90 is a decision step which determines which (possibly both) cans 44, 46 are operated and possibly also which particular release sequence is associated with a respective aerosol can 44, 46. Steps 92, 94 begin a particular release sequence for a respective aerosol can 44, 46. Another triggering input 88 can restart algorithm 86.

Aerosol delivery system 40 can include an end of battery sensor as part of electronic controller 52, or alternatively a separate end of battery sensor (not shown) which can alter dispense time as battery power becomes less effective in completely opening a solenoid valve. Aerosol delivery system 40 can also include an end of fragrance sensor as part of electronic controller 52, or alternatively a separate end of fragrance sensor (not shown) which can alter dispense time as the aerosol fluid pressure within an aerosol can becomes less therefore releasing less fluid for a given period of time that the solenoid valve is open.

Aerosol delivery system 40 can include a remote control (not shown) which can activate light sensor 64 or radio sensor 68, for example. Input/display unit 54 can be used to program a predetermined release sequence and/or to customize or create a new release sequence.

In use, the present invention discloses a method of discharging a plurality of aerosolized fluids from a plurality of aerosol cans 44, 46 to an ambient environment, including the steps of: fluidly coupling a first solenoid valve 48 of an aerosol delivery system 40 with a first discharge valve 70 on a first aerosol can 44; fluidly coupling a second solenoid valve 50 of aerosol delivery system 40 with a second discharge valve 72 on a second aerosol can 46; determining a first release sequence of a first aerosolized fluid from the first aerosol can 44, the first release sequence including both a first release period as a function of time and a first frequency of the first release period as a function of time; determining a second release sequence of a second aerosolized fluid from second aerosol can 46, the second release sequence including both a second release period as a function of time and a second frequency of the second release period as a function of time, the second release sequence being independent of the first release sequence; and actuating both first solenoid valve 44 and second solenoid valve 46 using an electronic controller 52 to thereby release both the first aerosolized fluid according to the first release sequence and the second aerosolized fluid according to the second release sequence to the ambient environment. The method of the present invention can further include the steps of: varying at least one of the first release period as a function of time and the first frequency as a function of time; varying at least one of the second release period as a function of time and the second frequency as a function of time; determining a first decreasing pressure profile over time of the first aerosolized fluid within first aerosol can 44; varying the first release sequence dependent on the first decreasing pressure profile; determining a second decreasing pressure profile over time of the second aerosolized fluid within second aerosol can 46; varying the second release sequence dependent on the second decreasing pressure profile; triggering at least one of the first release sequence and the second release sequence with at least one triggering event including at least one of an algorithm, a consumer selection, a manual input, a temperature input, an audio input, a light input, a motion input and a radio input; triggering the first release sequence with a first triggering event and triggering the second release sequence with a second triggering event different than the first triggering event; and indicating at least one of an end of battery condition and a end of fragrance condition.

Possible applications of the aerosolized fluids can include, but are not limited to: fragrance: home, office/work, auto, aromatherapy; odor elimination or neutralization chemical: home, auto, office/work; insecticide: indoor, outdoor; fabric freshening/protection chemical: storage areas, closets; camphor/menthol preparations: adult's bedroom, children's bedroom; anti-mold and anti-mildew chemicals: shower, cellar/basement, boat, recreational vehicles.

Although the present invention has been shown using the active delivery method of a pressurized canister or container with an aerosolized fluid, other active delivery methods such as convection driven vaporization, heat driven vaporization (e.g., electrical resistance and chemical processes such as oxidation and other chemical reactions), and other ambient temperature driven vaporization such as piezoelectric.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A method of discharging a plurality of aerosolized fluids from a plurality of aerosol cans to an ambient environment, comprising the steps of:

fluidly coupling a first solenoid valve of an aerosol delivery system with a first aerosol can;

fluidly coupling a second solenoid valve of said aerosol delivery system with a second aerosol can;

determining a first release sequence of a first aerosolized fluid from said first aerosol can, said first release sequence including both a first release period as a function of time and a first frequency of said first release period as a function of time;

determining a second release sequence of a second aerosolized fluid from said second aerosol can, said second release sequence including both a second release period as a function of time and a second frequency of said second release period as a function of time, said second release sequence being independent of said first release sequence; and actuating both said first solenoid valve and said second solenoid valve using an electronic controller electrically coupled to said first solenoid valve and said second solenoid valve to thereby release both said first aerosolized fluid according to said first release sequence and said second aerosolized fluid according to said second release sequence to the ambient environment.

2. The method of claim 1, further including the step of varying at least one of said first release period as a function of time and said first frequency as a function of time.

3. The method of claim 1, further including the step of varying at least one of said second release period as a function of time and said second frequency as a function of time.

4. The method of claim 1, further including the step of determining a first decreasing pressure profile over time of said first aerosolized fluid within said first aerosol can.

5. The method of claim 4, further including the step of varying said first release sequence dependent on said first decreasing pressure profile.

6. The method of claim 1, further including the step of determining a second decreasing pressure profile over time of said second aerosolized fluid within said second aerosol can.

7. The method of claim 6, further including the step of varying said second release sequence dependent on said second decreasing pressure profile.

8. The method of claim 1, further including the step of triggering at least one of said first release sequence and said second release sequence with at least one triggering event including at least one of an algorithm, a consumer selection, a manual input, a temperature input, an audio input, a light input, a motion input and a radio input.

9. The method of claim 8, wherein said first release sequence is triggered with a first triggering event and said second release sequence is triggered with a second triggering event different than said first triggering event.

10. The method of claim 1, further including the step of indicating at least one of an end of battery condition and a end of fragrance condition.

* * * * *